United States Patent [19]

Adler

[11] 4,302,902

[45] Dec. 1, 1981

[54] CLIMBING TOY

[76] Inventor: Alan J. Adler, 752 La Para Ave., Palo Alto, Calif. 94306

[21] Appl. No.: 33,698

[22] Filed: Apr. 26, 1979

Related U.S. Application Data

[63] Continuation-in-part of Ser. No. 798,804, May 20, 1977, abandoned.

[51] Int. Cl.[3] ..... A63H 11/04

[52] U.S. Cl. ..... 46/132

[58] Field of Search ..... 46/132, 1 R

[56] References Cited

U.S. PATENT DOCUMENTS

| | | | |
|---|---|---|---|
| 213,642 | 3/1879 | Farnum | 46/1 R |
| 446,535 | 2/1891 | Outerbridge | 46/1 R |
| 485,713 | 11/1892 | Shattuck | 46/132 |
| 1,249,538 | 12/1917 | Soth | 46/132 |
| 1,267,608 | 5/1918 | Vaughan | 46/132 |
| 1,462,090 | 7/1923 | Lindstrom | 46/132 |
| 1,762,620 | 6/1930 | Fixen | 46/132 |
| 1,876,481 | 9/1932 | Wright | 46/132 |
| 2,064,119 | 12/1936 | Irenins | 46/132 |
| 2,387,565 | 10/1945 | Criner | 46/132 |
| 3,935,667 | 2/1976 | Vitt | 46/132 |
| 3,983,661 | 10/1976 | Zitzmann | 46/132 |

*Primary Examiner*—Robert Peshock
*Assistant Examiner*—Michael J. Foycik, Jr.
*Attorney, Agent, or Firm*—Claude A. S. Hamrick

[57] ABSTRACT

A climbing toy including a body with two circumferential grooves of different depth. Strings are wound in opposite directions in the two grooves. The toy climbs when tension is applied to the two strings. The toy contains no axles, bearings or other mechanisms.

5 Claims, 7 Drawing Figures

CLIMBING TOY

The application is a continuation-in-part of Ser. No. 798,804 filed May 20, 1977 now abandoned.

BACKGROUND OF THE INVENTION

The present invention relates to amusement devices or toys, and more specifically to climbing toys.

Discussion of the Prior Art

Climbing toys which employ the principal of a differential spool (or differential pulley) have been known for some time. Such a toy was patented in 1879 by W. C. Farnum and called the "Obedient Ball" (U.S. Pat. No. 213,642). It consists of a hollow ball-shaped structure (body) containing an axle and a spool mounted on the axle. The spool is axially divided into two sections which have winding surfaces of different diameters.

Strings are wound in opposite directions on these two surfaces and the string wound on the smaller diameter surface is pulled upwards while the string wound on the larger diameter surface is pulled downwards. Applying tension in this manner causes the spool to rotate and climb the string. This is due to the difference in leverage caused by the different diameters.

String tension also causes a tilting moment, normal to the axis of the spool, which is absorbed by string guides (holes) in the outer ball-shaped body.

Subsequent to Farnum's invention there have been a number of similar devices, all employing the same principal, but with minor variations in the structure. Some of these later inventions have used a cylindrical body (similar to Yo-Yo) while others have used a body which simulated an animal. In all cases the differential spool was mounted on an axle and string guides were included in the outer structure to absorb the tilting moment. A list of these U.S. Pat. Nos. follows: 446,535, 485,713, 1,249,538, 1,267,608, 1,462,090, 1,762,620, 2,387,565, 3,983,661.

The present inventor has experimented with climbing toys of this type and found that they have several problems:

a. The string, being enclosed within the outer body, is subject to tangles and it is difficult to access the area of these tangles.
b. The friction of the string-guides impairs the climbing movement of the toy.
c. The obvious complication and presence of mechanism detracts from the quality of the physical illusion.
d. The complication of the mechanism increases the toy's cost and reduces its reliability.

B. R. Wright (U.S. Pat. No. 1,876,481) eliminated the axle, outer body, and string-guides by employing a spool with three winding surfaces. The two outer surfaces carried the upward-pulling winding while the central winding surface carried the downward pulling winding (or vice-versa). This arrangement was an attempt to balance out the tilting moment and thus eliminate the need for an outer structure and string-guides. Wright used tapes instead of strings and all three winding surfaces of the spool were of identical diameter. However, diameter differences (which are essential to make the toy climb) were created by winding different amounts of tape on the spool surfaces.

The present inventor has constructed models of the Wright invention and discovered several limitations:

a. The three tapes are tricky to wind because the center tape must be wound in an opposite direction from the two outer tapes. This requires a great deal of patience and dexterity.
b. Slight variations in the stretch and thickness of the two outer tapes can cause enough tilt in the spool to make it spill its tapes - requiring that the patience-taxing winding procedure be repeated.
c. Because all three winding surfaces are of the same diameter, the essential diameter differences must be acheived by the thicknesses of the tape windings. This leads to inconsistent and confusing operation.

The present invention

An object of the present invention is to offer a climbing device or toy which has no mechanism and is thus free of the aforementioned problems associated with the Farnum type toys and yet is also free of the problems inherent in the Wright three-tape type of device.

THE DRAWINGS

DETAILED DESCRIPTION OF THE INVENTION

Figure 1:
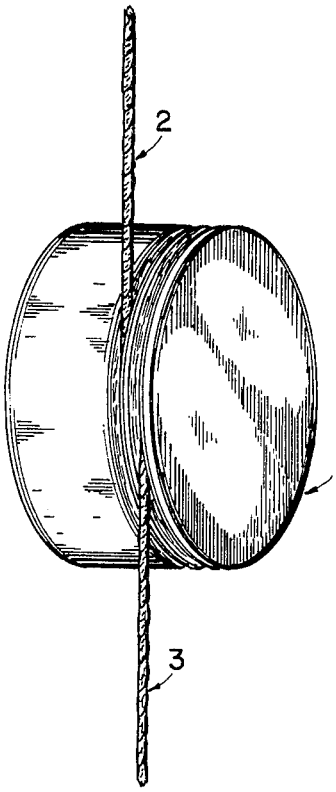
FIG. 1 is a perspective of a preferred embodiment of the present invention in operation.
Figure 2:
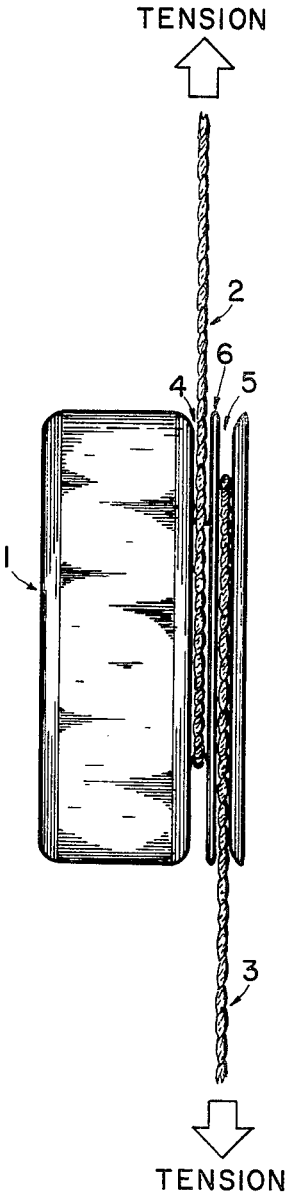
FIG. 2 is a front view of the invention, illustrating the string grooves and tension in the strings.

Referring to FIGS. 1 and 2, note that the invention consists of a spool 1 with two adjacent relatively deep grooves 4,5 and strings 2,3 wound in opposite directions in the two grooves. Groove 5 is shallower and thus has a larger radius (the radius is the distance from the center of gravity of the body to the bottom of the groove) than the other groove and is wound with the downward-pulling string. When the strings are pulled in opposite directions the greater leverage applied at the larger radius groove 5 causes the spool body to rotate and climb the other string 2. Reducing tension on the strings allows gravity to pull the body downward, unwinding the upper string and winding the lower string.

Figure 3:
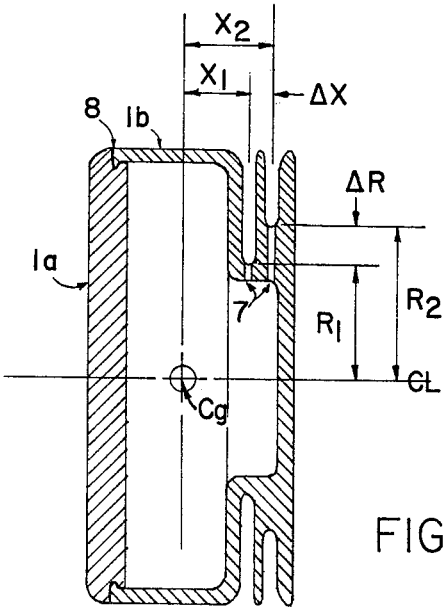
FIG. 3 is a cross section of one embodiment of the invention, showing a hollow body composed of two molded parts. This figure also serves as a reference for the geometrical analysis which follows.

An important difference between the present invention and the prior art is that the strings are wound in deep, narrow grooves—rather than on relatively wide and shallow winding surfaces. The deep, narrow grooves guide the string and also absorb the tilting moment, which as explained before, is normal to the spool's axis. In addition, the deep, narrow grooves control the axial position of the strings. This permits placing the strings close together to minimize the tilting moment. In practice it has been found that the invention works best when the groove depth is three to ten times greater than its width. In the example of FIGS. 1 through 3 the shallower (larger radius) groove is 0.10 inches wide and 0.50 inches deep while the deeper (smaller radius) groove is the same width and 0.75 inches deep. The two grooves are separated by a narrow web 6 which should be just as narrow as the practical considerations of the material strength and stiffness will permit. (In the example the web is 0.050 inches wide.)

The example shown in FIGS. 1 through 4 all embody an additional advantage over the prior art. As previously described, tension in the strings caused an undesireable tilting moment which is absorbed by the string-guides of the Farnum type toy or can be absorbed by the deep grooves of the present invention. However, by axially offsetting the the grooves, as shown in FIGS. 1 through 4, the tilting moment due to string tension can be counterbalanced by the opposite tilting moment caused by gravity acting on the axially offset center of mass of the spool body.

Referring to FIG. 3, note that the radii of the two grooves are shown as $R_1$ and $R_2$ and the difference between them is designated $\Delta R$. The axial distances from the center of gravity (or center of mass) to the center of each of the respective grooves are designated $X_1$ and $X_2$, and the difference is $\Delta X$. An analysis of the forces shows that the tilting moment will be counterbalanced when the following geometric conditions are fullfilled:

$$\frac{R_2}{\Delta R} = \frac{X_2}{\Delta X} \quad (1)$$

In practice the radii vary somewhat depending on the amount of string wound in the grooves. However, experience has shown that good performance is acheived if the device satisfies the above equation when in the unwound state. Small departures from perfect counterbalancing (due to the thicknesses of the string windings) are easily dealt with by the ability of the sides of the deep grooves to absorb the tilting moment.

Tension in the string can also be analysed by a simple equation:

$$T = W\frac{R_2}{\Delta R}$$

Figure 4:
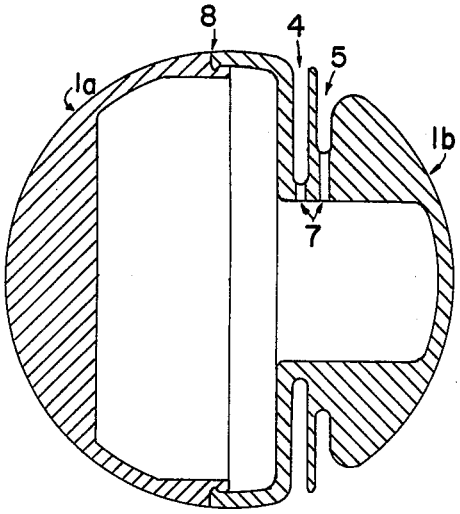
FIG. 4 is a cross section of an alternate embodiment of the invention which has a spherical body.

It is desireable to keep the tension below 0.5 lbs while still maintaining a high ratio of $R_2/\Delta R$ (which causes a rapid and pleasing climb of the spool body). This necessitates making the spool body light in weight. Low weight can be acheived by choosing a lightweight material, such as plastic or foam, or wood, and/or by making the body hollow, as shown in FIGS. 3 and 4.

In these figures the body is shown as being comprised of two parts 1*a* and 1*b*, joined together by a snap lock joint 8. A pair or radial holes 7 are used to connect the strings to the body. The strings may be separate and retained by knotting them inside of the holes, or a single continuous string may pass in through one hole and out through the other hole in order to retain it to the body.

Figure 5:
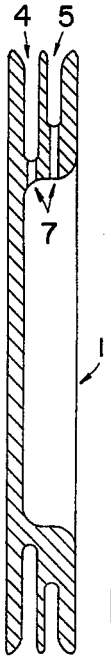
FIG. 5 is a cross section of an alternate embodiment of the invention which has a relatively thin flat body.

Although considerable discussion has been devoted to the benifits of the counterbalanced configuration as shown in FIGS. 1 through 4 it is emphasised that a non-counterbalanced configuration, such as is shown in FIG. 5, also works well provided that the deep, narrow grooves of the present invention are employed. Note that the mouths of the grooves should always be rounded and smooth in order to guide the string and reduce friction. This is particularly desireable in the non-counterbalanced configuration.

The counterbalanced condition can be acheived, if desired, by attaching a balancing appendage to a non-counterbalanced body. This appendage might take the form of a figure or it might be allowed to move with respect to the body in order to create some further visual effect.

Figure 6:
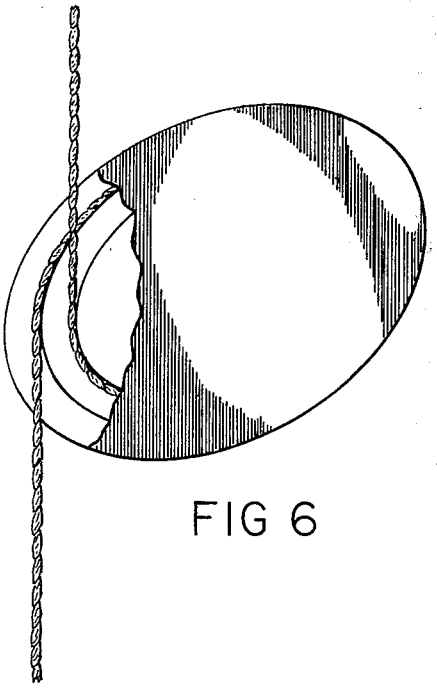
FIG. 6 is a side view of an alternate embodiment which has an elliptical shape.
Figure 7:
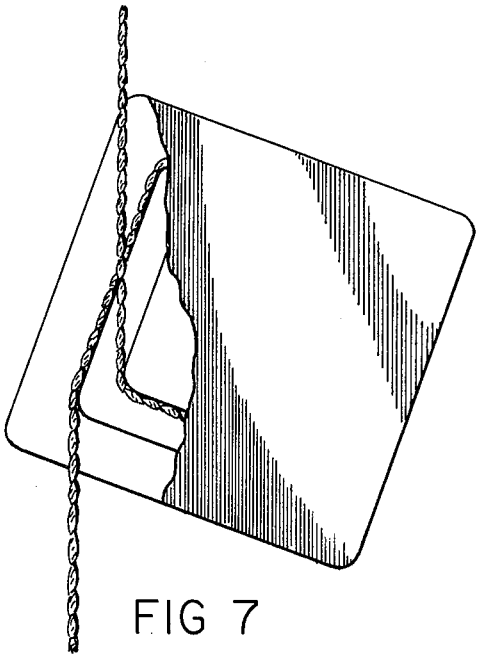
FIG. 7 is a side view of an alternative embodiment which has a square shape. (note that FIGS. 6 and 7 are both partially cut away to reveal strings)

Non-circular bodies (and groove paths) will also climb the string quite well. FIGS. 6 and 7 illustrate elliptical and square planforms respectively. Although both of these examples are regular shapes, irregular shapes or polygons will also climb well provided that the radius (distance from the center of gravity) of the point of tangency of the downward-pulling string is always greater than the radius of the upward-pulling string. Furthermore, the grooves may be eccentric, provided that the above rule of the radii is met. Of course, both counterbalaced and non-counterbalanced configurations of the non-circular versions can be made. One interesting possibility is to combine eccentric or non-circular groove paths and varying axial spacing between the grooves in a manner which acheives counterbalancing.

While in the foregoing specification embodiments of the invention have been set forth in considerable detail for purposes of making a complete disclosure thereof, it will be apparent to those skilled in the art that numerous changes may be made in such details without departing from the spirit and principles of the invention.

I claim:

1. A string climbing device consisting of:

a round body means having an axis of revolution passing through the center of gravity of said body means;

first and second annular grooves circumscribing said body means and respectively describing first and second planes which are both perpendicular to said axis of revolution, said first and second planes intersecting said axis of revolution at points which are removed from said center of gravity by distances $X_1$ and $X_2$ respectively, said first and second grooves each having depths which are at least three times greater than their width and having respective radii $R_1$ and $R_2$ measured from said axis of revolution to the bottom of each groove, said radii $R_1$ and $R_2$ being related to the distances $X_1$ and $X_2$ so as to substantially satisfy the following equation:

$$\frac{R_2}{\Delta R} = \frac{X_2}{\Delta X}$$

where $\Delta R = R_2 - R$hd 1 and $\Delta X = X_2 - X_1$; and string means freely wound in opposite directions in each of said grooves such that tension applied to said string means causes said body means to rotate and move along said string means, and whereby any tilting moment caused by said tension is counteracted by the tilting moment caused by the offset of said center of gravity relative to the center of spacing between said first and second grooves.

2. A string climbing device as recited in claim 1 wherein said body means is substantially cylindrical in shape and said grooves follow a circular path around the perimeter of said cylindrical body means.

3. A string climbing device as recited in claim 1 wherein said body means is substantially spherical.

4. A string climbing device as recited in claim 1 wherein said body means is comprised of at least two mating parts which are joined together to form a body having a hollow interior cavity, thereby reducing the weight of said body means.

5. A string climbing device as recited in claim 1 wherein said body means is comprised of at least two mating parts which are joined together to form a body having a hollow interior cavity, thereby reducing the weight of said body means and facilitating said axial offset of said center of gravity.

* * * * *

UNITED STATES PATENT OFFICE

CERTIFICATE OF CORRECTION

Patent No. 4,302,902 Dated December 1, 1981

Inventor(s) Alan J. Adler

It is certified that error appears in the above-identified patent and that said Letters Patent are hereby corrected as shown below:

Column 4, line 56, should read

--where $\Delta R=R_2-R_1$ and $\Delta X=X_2-X_1$; and--

Signed and Sealed this

Thirtieth Day of March 1982

[SEAL]

Attest:

GERALD J. MOSSINGHOFF

Attesting Officer

Commissioner of Patents and Trademarks